United States Patent [19]

Eaton

[11] Patent Number: 4,917,194

[45] Date of Patent: Apr. 17, 1990

[54] IMPROVED DOWNHOLE HAMMER

[75] Inventor: Ronald E. Eaton, Midvale, Australia

[73] Assignee: Wallis Industries Pty Ltd., Midvale, Australia

[21] Appl. No.: 324,566

[22] Filed: Mar. 16, 1989

[30] Foreign Application Priority Data

Nov. 9, 1988 [AU] Australia ..... 24998/88

[51] Int. Cl.[4] ..... E21B 17/00

[52] U.S. Cl. ..... 173/136; 173/66; 173/79; 175/92; 175/215

[58] Field of Search ..... 173/57, 66, 67, 78–80, 173/138, 136; 175/92, 215

[56] References Cited

U.S. PATENT DOCUMENTS 3,795,283 3/1974 Oughton ..... 173/73

*Primary Examiner*—Frank T. Yost
*Assistant Examiner*—Rinaldi Rada
*Attorney, Agent, or Firm*—Harness, Dickey & Pierce

[57] ABSTRACT

A downhole hammer is provided comprising a casing having a top sub at one end and a drill bit and support at the other end. A central tube is extended therethrough to define an annular space between the casing and the tube. A reciprocating piston is accommodated within the annular space and is operated by injecting a pressurized fluid from the surface into the annular space via a plurality of ports in the casing. The pressurized fluid is exhausted into the central tube and toward the surface via a plurality of passageways therethrough without contacting the borehole.

6 Claims, 6 Drawing Sheets

IMPROVED DOWNHOLE HAMMER

BACKGROUND OF THE INVENTION

This invention relates to a downhole hammer and in particular relates to a recirculating downhole hammer.

SUMMARY OF THE INVENTION

Throughout the specification reference may be made to particular directional orientations of components and/or movement of components, however, it should be appreciated that such reference is for the purpose of explanation only and is not intended to be limiting the scope of application of the items being described.

In one form the invention resides in a downhole hammer comprising a substantially cylindrical casing having a top sub at one end and a drill bit support at the other, a central tube extending from the top sub through the casing to the drill bit support to define an annular space between the internal face of the casing and the external face of the central tube, said drill bit support supporting a drill bit having a passageway in alignment with the interior of the central tube, said top sub accommodating a return passageway opening into the interior of the central tube, an annular piston reciprocally accommodated within the annular space for movement between an impact position at which said piston abuts said drill bit support and a raised position at which said piston is raised from the drill bit support, an annular passageway being formed between the external face of the central tube and the internal bore of the piston, the exhaust from the annular space during reciprocation of the piston being exhausted into the annular passageway wherein said fluid in said annular passageway is exhausted into the interior of the central tube at two axially spaced locations along the central tube.

The invention will be more fully understood in the light of the following description of one specific embodiment.

BRIEF DESCRIPTION OF THE DRAWINGS

The description is made with reference to the accompanying drawings of which.

DESCRIPTION OF PREFERRED EMBODIMENTS

Figure 1A:
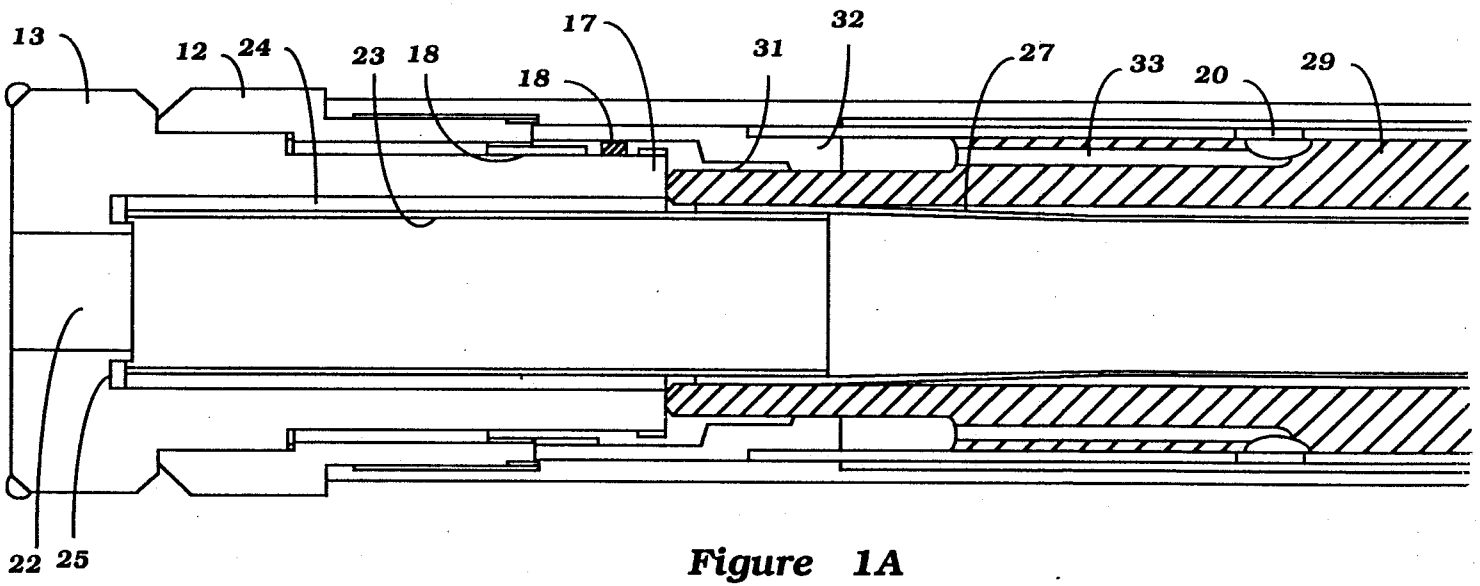
FIGS. 1*a* and 1*b* are a sectional elevation of a downhole hammer according to the embodiment with the piston in the impact position.

The embodiment is directed towards a downhole recirculating hammer having a top sub 10 mounted to one end of a cylindrical casing 11 which supports a drill bit support 12 at the other end which in turn supports a drill bit 13 which is axially slidable within the drill bit support 12 between two end positions wherein when the drill bit 13 is at its innermost position it is abutting relationship with the end of the drill bit support 12 and when at its outermost position it is retained thereat by the enlarged end of the anvil portion 17 of the drill bit being in engagement with a bit retaining ring 18 provided within the drill bit support 12.

The top sub 10 supports an inner tube 14 which is intended to be engaged with the return flow line of the drill string and which defines an annular space between the external face of the inner tube 14 and the interior face of the top sub 10. The annular space is in communication with a source of fluid pressure and is provided at its innermost end with a series of radially divergent passageways 15 which communicate with a first annular passageway 16 provided in the walls of the casing 11. Two sets of axially spaced fluid inlet ports 20 and 21 are provided on the inner wall of the casing 11 to provide communication between the first annular passageway 16 and the interior of the casing 11.

The drill bit 13 is formed with a central aperture 22 in its cutting face 13 which opens into a central passageway within the drill bit. The central passageway of the drill bit supports a first central tube 23 in a counter bored portion of the central passageway such that it is supported in spaced relation from the side walls of the central passageway to define a second annular passageway 24. The counter bored portion extends from the anvil end towards the cutting face of the drill and terminates in a curved end face. The outermost end of the first central tube 23 is spaced from the curved end face 25 of the counter bored portion of the axial passageway by suitable spacers while the innermost end of the central tube 23 extends beyond the anvil 17 of the drill bit 13. The outermost end of the second annular passageway 24 terminates with the curved end face 25 of the counter bored portion which serves to direct any fluid flow flowing through the second annular passageway towards the flange 25 to be turned through approximately 180° whereby it is directed axially inwardly along the interior of the first central tube 23.

The top sub 10 supports a second central tube 26 which is fixed to the top sub 10 to open into the interior of the inner tube 14 of the top sub 10. The second central tube 26 is substantially parallel sided for most of its length, however, at its outermost end it has an increased diameter portion 27 which overlies the innermost end of the first central tube 23 and is dimensioned such that the inner face of the increased diameter portion of the second central tube 26 is spaced from the outer face of the innermost end of the first central tube 23. The second central tube 26 provides an annular space between the external face thereof and the internal face of the casing 11.

An annular piston 29 is slidably received within the annular space and has an outer face of a diameter corresponding to the inner diameter of the casing 11 whereby its outer face is substantially slidably and sealingly engaged with the inner face of the casing 11. A third annular passageway is formed between the bore of the piston and the outerface of the second tube 26.

The top sub 10 further supports a third central tube 28 which is of a larger diameter than the second central tube 26 but extends for only a portion of the length of the annular space and defines a fourth annular passageway between the third central tube and the second central tube. The fourth annular passageway opens into the interior of the inner tube 14 of the top sub through a set of ports 35 at the junction between the inner tube 14 and the second central tube 26.

Figure 1B:
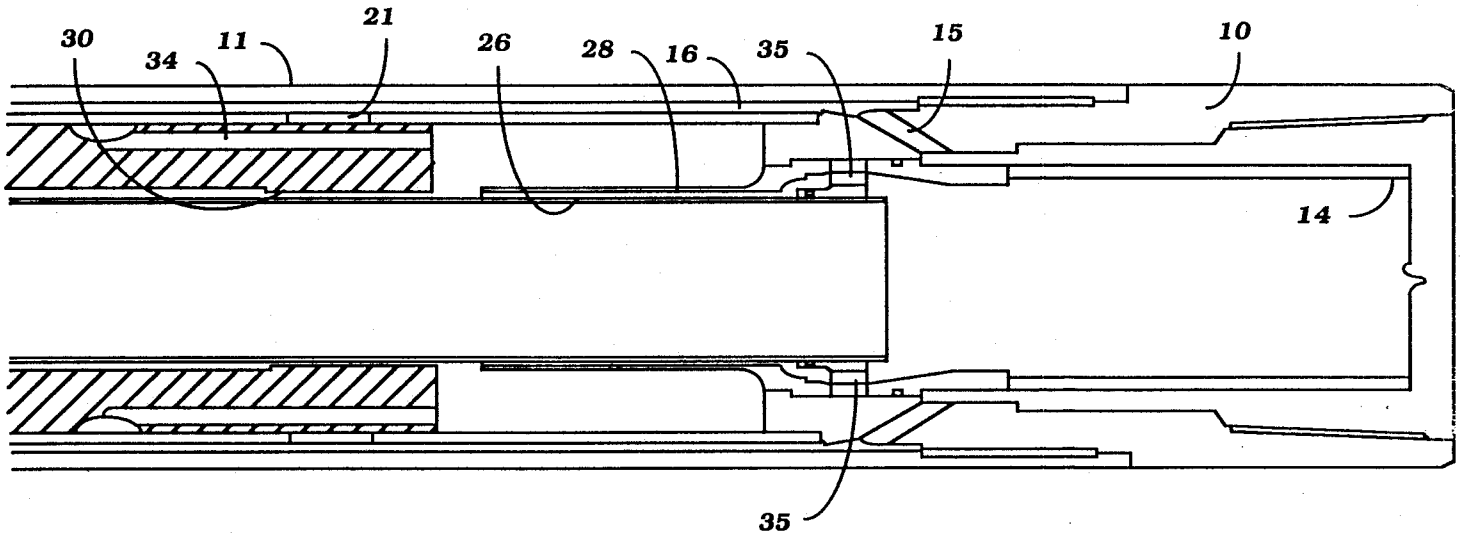
Figure 2A:
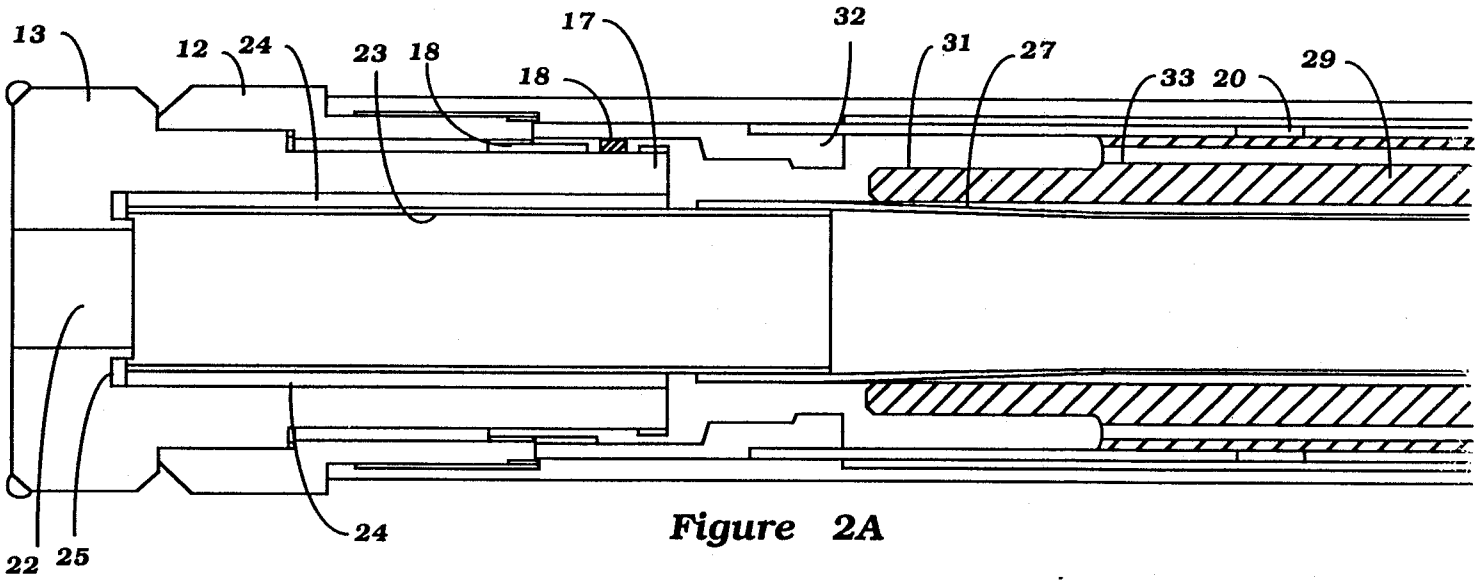
FIGS. 2*a* and 2*b* are a sectional elevation of the embodiment with the piston in the raised position.
Figure 2B:
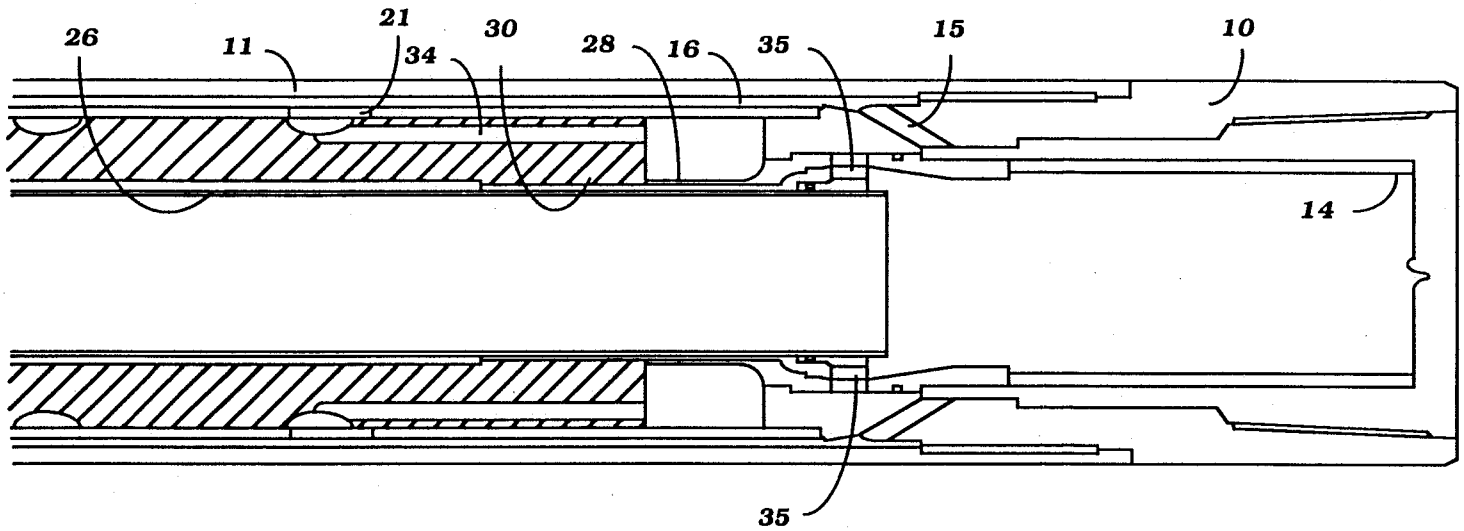

In addition the inner bore of the piston 29 at its innermost end is formed with a reduced diameter portion 30 which is of a dimension such that it is slidably and sealingly engaged with the outer face of the third tube 28 when the piston is in its raised position away from the anvil 17 of the drill bit as shown at FIG. 2. The outermost end of the piston 29 is formed on its outer face with a reduced diameter portion 31 which is slidably and sealingly engaged with the innermost end 32 of the drill bit support 12 when the piston is at the impact position and approaching the impact position as shown at FIG. 1. The piston is formed with two sets of fluid inlet ports 33 and 34 which periodically communicate with the sets of fluid inlet ports 20 and 21 respectively in the casing 11 when in communication therewith to allow for the introduction of fluid into the space defined between the respective ends of the piston and the casing 11. When the piston is in its impact position as shown at FIG. 1, the first inlet port 20 in the casing opens into the first inlet port 33 in the piston 29 to cause fluid to be introduced into the space defined between the reduced diameter portion 31 of the piston the inner end 32 of the drill bit support 12 and the casing 11 to cause sufficient build up in pressure to drive the piston 29 away from the anvil 17 of the drill bit 13. The other end of the piston 29 is spaced from the outermost end of the third central tube 28 and as a result fluid is displaced by the axial movement of the piston 29 into the third annular passageway defined between the inner radial face of the piston 29 and the outer face of the second central tube 26 with further axial movement of the piston 29 the outermost end of the piston disengages from the innermost end 32 of the drill bit support 12 to allow the fluid entrapped therebetween to be exhausted into the third annular passageway defined between the inner radial face of the piston 29 and the outer face of the second central tube 26. At the other end the piston 29 is sealingly engaged with the outermost end of the third central tube 28 and towards the end of its movement the second set of inlet ports 34 in the piston communicate with the second set of inlet ports 21 in the inner wall of the casing to allow for the entry of fluid into the space defined between the innermost end of the piston 29 and the top sub 10 in order to deccelerate the piston in its movement towards the top sub 10 and then drive it towards the anvil 17 of the drill bit 13. During such movement of the piston 29 towards the anvil 17 the fluid in the space between the drill bit support and the outermost end of the piston 29 is displaced into the third annular space passageway between the second central tube 26 and the inner bore of the piston 29 until such time as the outermost end of the piston sealingly engages the innermost end 32 of the drill bit support 12.

As a result of the construction of the hammer according to the embodiment the fluid is exhausted from either end of the piston 29 into the third annular passageway defined between the piston and the second central tube 26. Such fluid is permitted to exhaust into the interior of the second central tube 26 through the passageway defined between overlapping spaced ends of the first and second central tubes 23 and 26. Such fluid is also permitted to exhaust into the interior of the first central tube 23 by passing through the second annular passageway and between the outer end of the first central tube 23 and the curved end face 25. Furthermore, such fluid is also permitted to enter the interior of the inner tube 14 of the top sub 10 by passing through the fourth annular passageway between the second central tube 26 and the third central tube 28 and to the series of exhaust ports 35 provided in the top sub at the support for the second central tube 26.

The entry of air into the first central tube 23 at the inner end of the aperture 22 in the drill bit 13 serves to provide a reduced pressure zone in the region of the aperture 22 to draw cuttings into the first central tube 23. The further introduction of fluid into the interior of the second central tube 26 through the third annular passageway at the junction with the first central tube 23 serves to enhance the flow of materials along the second central tube 26. In addition the exhausting of fluid into the inner tube 14 in the top sub 10 serves to overcome any decceleration of materials that may result from the increased volume of the inner tube 14 and serves to maintain the cuttings in suspension.

An advantage of the embodiment and invention arises from the circumstance that no exhaust fluid from the hammer during the operation of the hammer is injected into the space between the hammer and the bore hole since all of the exhaust fluid is injected into the central return passageway within the hammer. As a result none of the substrate through which the bore hole is being formed is pressurised which can in some instances result in destabilisation of the substrate to cause the borehole to collapse on the hammer during its passage through the substrate.

Figure 3A:
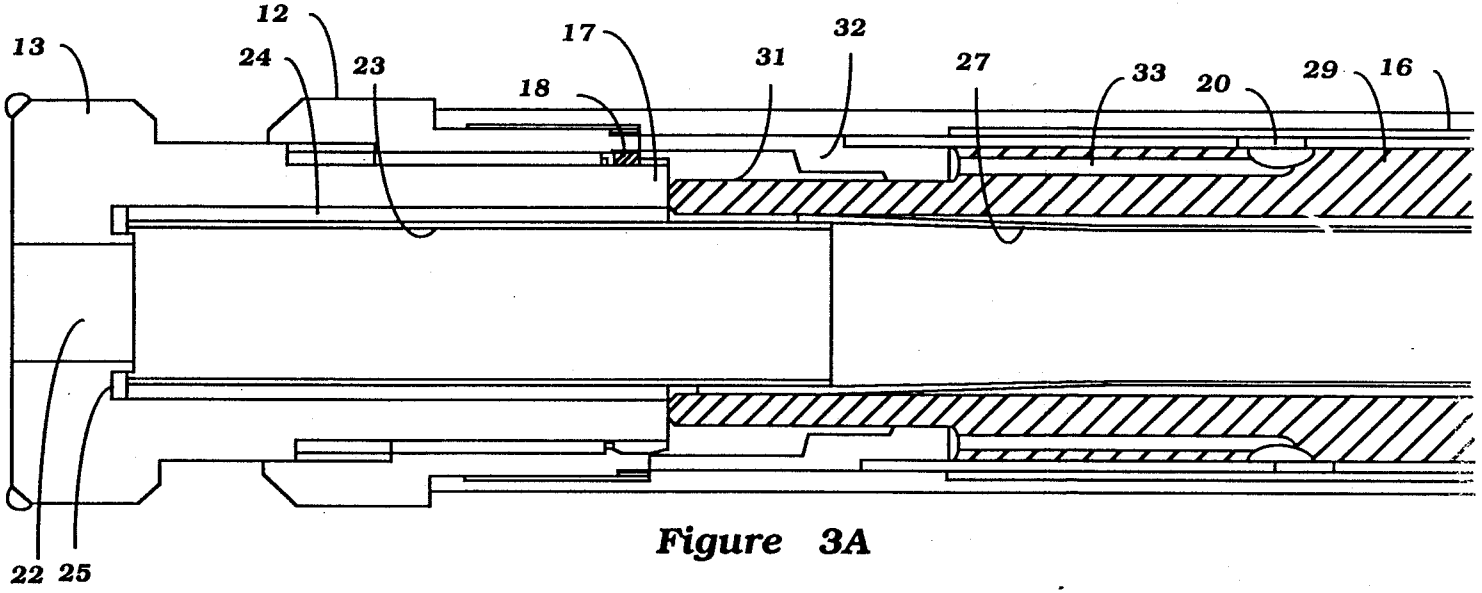
FIGS. 3*a* and 3*b* are a sectional elevation of the piston according to the embodiment in the "blow down" position.
Figure 3B:
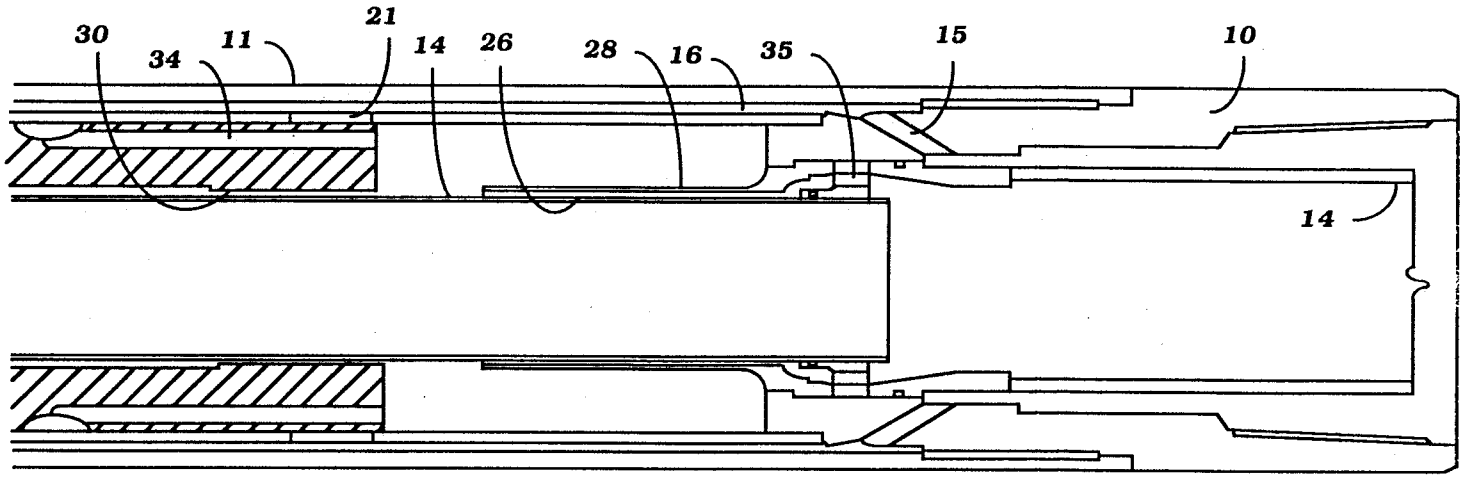

When the hammer is in the blowdown mode as shown in figure 3 the flange formed at the outermost end of the piston by the reduced diameter portion 31 is in abutment with the innermost end 32 of the drill bit support 12 while the outermost end of the piston is also in abutment with the anvil 17 of the drill bit. The fluid from the first annular passageway 16 in the casing is caused to enter the annular space between the innermost end of the piston 29 and the top sub 10 through the second inlet port 21 in the casing to pressurise that space and is exhausted into the third annular passageway between the second central tube 26 and the bore of the piston 29 to exit from the space between the outer end of the first central tube 23 and the curved end face 25 of the counter bored portion of the drill bit and between the spaced overlapping portions of the first and second central tube 26 and also to exhaust through the space between the second and third central tubes 26 and 28 respectively.

It should be appreciated that the scope of the present invention need not be limited to the particular scope of the embodiment described above.

What is claimed is:

1. A downhole hammer comprising a substantially cylindrical casing having a top sub at one end and a drill bit support at the other end, a central tube extending from the top sub through the casing to the drill bit support to define an annular space between an internal face of the casing and an external face of the central tube, said drill bit support supporting a drill bit having a central axial aperture in alignment with an interior of the central tube, said top sub accommodating a return tube opening into the interior of the central tube, said aperture, central tube and return tube defining a return passageway, an annular piston reciprocally accommodated within the annular space for movement between an impact position at which said piston abuts said drill bit support and a raised position at which said piston is raised from the drill bit support, an annular passageway being formed between the external face of the central tube and an internal bore of the piston capable of receiving exhaust from the annular space during reciprocation of the piston, and two axially spaced flow paths along the central tube for disposing said exhaust into the return passageway from the annular passageway, a first of said two flow paths defined by an opening in the central tube proximal the position at which said piston abuts said drill bit support and distal a cutting face of the drill bit, the opening of said first flow path into the return passageway being directed substantially axially along the return passageway in a direction away from the cutting face.

2. A downhole hammer as claimed at claim 1 further comprising a second of said two flow paths defined by an opening in the central tube proximal the cutting face of the drill bit and distal the position at which said piston abuts said drill bit support, the opening of said second flow path into the return passageway being directed substantially axially along the return passageway in a direction away from the cutting face.

3. A downhole hammer as claimed at claim 2 wherein the opening of said second flow path occurs at a point where the central tube overlaps an inner end of the aperture in the drill bit and is spaced radially therefrom.

4. A downhole hammer as claimed in claim 3 wherein an element having two axial ends and having an external diameter corresponding to the internal diameter of an end of the piston proximate to the top sub is located over the central tube adjacent the top sub to be sealingly and slidably engaged by the piston when at said raised position, a third flow path extending between the axial ends of the element to provide fluid communication between the annular passageway and the return passageway.

5. A downhole hammer as claimed in claim 2 wherein an element having two axial ends and having an external diameter corresponding to the internal diameter of an end of the piston proximate to the top sub is located over the central tube adjacent the top sub to be sealingly and slidably engaged by the piston when at said raised position, a third flow path extending between the axial ends of the element to provide fluid communication between the annular passageway and the return passageway.

6. A downhole hammer as claimed in claim 1 wherein an element having two axial ends and having an external diameter corresponding to the internal diameter of an end of the piston proximate to the top sub is located over the central tube adjacent the top sub to be sealingly and slidably engaged by the piston when at said raised position, a third flow path extending between the axial ends of the element to provide fluid communication between the annular passageway and the return passageway.

* * * * *